US007045037B2

(12) United States Patent
Conrad

(10) Patent No.: US 7,045,037 B2
(45) Date of Patent: May 16, 2006

(54) PROCESS FOR CLEANING A ROLL IN A CALENDER

(75) Inventor: Hans-Rolf Conrad, Dormagen (DE)

(73) Assignee: Voith Paper Patent GmbH, Heidenheim (DE)

( * ) Notice: Subject to any disclaimer, the term of this patent is extended or adjusted under 35 U.S.C. 154(b) by 160 days.

(21) Appl. No.: 10/636,550

(22) Filed: Aug. 8, 2003

(65) Prior Publication Data

US 2004/0035536 A1 Feb. 26, 2004

(30) Foreign Application Priority Data

Aug. 24, 2002 (DE) ..... 102 38 949

(51) Int. Cl.
*D21G 1/00* (2006.01)
*B08B 3/10* (2006.01)
*B08B 7/02* (2006.01)

(52) U.S. Cl. ..... 162/199; 162/198; 162/263; 162/272; 162/118; 162/197; 134/9; 134/64 R

(58) Field of Classification Search ..... 162/198, 162/199, 263, 255, 272–279, 281, DIG. 6, 162/DIG. 10, DIG. 11, 118–121, 197; 100/155 R, 100/162 R; 101/425, 484; 15/256.5; 134/9, 134/18, 26, 30, 32, 64 R
See application file for complete search history.

(56) References Cited

U.S. PATENT DOCUMENTS

| | | | | |
|---|---|---|---|---|
| 1,679,711 | A | 8/1928 | Dawe | |
| 4,781,116 | A * | 11/1988 | Harada | 101/425 |
| 4,930,415 | A * | 6/1990 | Hara et al. | 101/228 |
| 4,953,252 | A | 9/1990 | Akisawa | |
| 5,080,015 | A * | 1/1992 | Hansson et al. | 101/483 |
| 5,524,805 | A * | 6/1996 | Shiba et al. | 226/108 |
| 6,332,929 | B1 * | 12/2001 | Hartmann et al. | 134/6 |
| 6,401,619 | B1 * | 6/2002 | Lundin et al. | 101/483 |

FOREIGN PATENT DOCUMENTS

| | | | |
|---|---|---|---|
| WO | WO02/20901 | | 3/2002 |
| WO | WO 02/20901 | * | 3/2002 |

* cited by examiner

*Primary Examiner*—Eric Hug
(74) *Attorney, Agent, or Firm*—Greenblum & Bernstein, P.L.C.

(57) ABSTRACT

Process for cleaning at least one roll of a calender. The process includes guiding a web over a surface of the at least one roll of the calender to be cleaned, and producing a relative speed difference between the surface of the least one roll and a section of the web lying against the surface of the a least one roll. The instant abstract is neither intended to define the invention disclosed in this specification nor intended to limit the scope of the invention in any way.

36 Claims, 2 Drawing Sheets

PROCESS FOR CLEANING A ROLL IN A CALENDER

CROSS-REFERENCE TO RELATED APPLICATIONS

The present application claims priority under 35 U.S.C. §119 of German Patent Application No. 102 38 949.7 filed Aug. 24, 2002, the disclosure of which is expressly incorporated by reference herein in its entirety.

BACKGROUND OF THE INVENTION

1. Field of the Invention

The invention relates to a process for cleaning a roll in a calender over which roll a web is guided.

Further, while the exemplary embodiment of the instant invention is described with reference to a paper web, it is contemplated that other types of webs can likewise be utilized without departing from the scope and spirit of the instant invention.

2. Discussion of Background Information

When a paper web runs through a calender, it is acted on with increased pressure and possibly also with increased temperature. Moreover, it can frequently be observed that deposits, e.g., fibers detached from the paper web, form on rolls of the calender.

It is therefore known to provide cleaning devices on rolls in a calender, which devices comprise, e.g., brushes, cloths, sanding belts, scrapers or the like. These cleaners can be installed on the roll and remove the deposits or other contaminants. When the cleaners are narrower than the roll, these cleaners traverse across the roll width. With these devices, auxiliary equipment is also known, e.g., devices for applying cleaning fluid, devices for detecting soiled areas or drawing off the dirt by suction.

These devices entail considerable expense and are mechanically sensitive.

SUMMARY OF THE INVENTION

The present invention provides a process to clean a roll in a cost-effective and technically simple manner.

The instant invention is directed to a process of the type mentioned at the outset that also includes, during the passage of a section of the web, producing a relative speed difference between the web lying against the roll and the surface of the roll and disposing of the section.

With this approach, additional devices that have heretofore been installed on the roll in order to remove contaminants are no longer necessary. Instead, the process according to the invention utilizes the web itself to rub off contaminants. To this end it is merely necessary for the web and the surface of the roll to have different speeds, so that the web lying against the roll rubs over the surface. The speed difference between the surface of the roll and the web is then the relative speed. The web itself then removes contaminants from the surface of the roll by abrasion and at the same time discharges them. The part of the web which is used to clean the roll becomes soiled and is, therefore, disposed of. Thus, although part of the web is lost, this is not critical, because the cleaning process only takes a relatively short period of time relative to the entire production time of a calender. A "fresh" web is always used for cleaning, which removes the contaminants immediately after they are detached. This rules out the risk of contaminants that have been removed from the roll returning to the surface of the roll again via the "cleaning device." Cleaning the roll surface with the aid of the web is technically very simple. No additional, mechanically sensitive structural components or assemblies are necessary.

A nip, which is limited or defined by the roll, is preferably opened before the passage of the section. Thus, the relative speed between the web and the surface of the roll can be set relatively freely. The danger of the web tearing due to an excessive pressurization is relatively small. Moreover, with a paper or cardboard web, opening the nip of the calender has the advantage that the web is not glazed, whereby a "rougher" web intensifies the cleaning effect still further.

The web is preferably stretched against the roll during the passage of the section. Even with an opened nip, a relatively large force is then produced with which the web is pressed against the roll. Of course, this force is substantially smaller than the compressive strains that prevail in the nip with a closed nip. However, the force that can thereby be generated is sufficient for the web to lie against the roll with the necessary tension to remove the contaminants.

It is also preferred that an angle of wrap of the web around the roll is enlarged during the passage of the section. The larger the area with which the web lies against the surface of the roll, the better the cleaning effect. The cleaning process can then be shortened. The angle of wrap can be altered, e.g., by displacing guide rolls.

Cleaning preferably occurs shortly after or shortly before a reel spool is changed on which the web is wound. The soiled section of the web is then located either on the very outside or the very inside of the reel spool. In many cases these two areas have to be discarded at least partially anyway. Therefore, virtually no losses or only small losses occur through the cleaning process. Alternatively, of course, a separate reel spool can also be interposed which is provided only to wind up the soiled section of the web.

In another alternative it is provided that the cleaning takes place during a reel spool change and the section is guided into a pulper. This possibility presents itself above all when the degree of contamination is only slight. The raw material of the section of the web used for cleaning can then be recovered.

Preferably, the relative speed is set at at least 100 m/min. An adequate cleaning effect can be achieved through such a speed difference between the speed of the web and the speed of the surface of the roll. However, if a greater speed is selected, e.g., several hundred m/min, the cleaning effect is improved.

To produce the relative speed, a change is preferably made in the drive of the roll. The speed of the web can then be left unchanged. For example, the web can be wound at an unchanged speed. The change in the drive of the roll can be, e.g., that the roll is driven faster. However, it can also be that the roll is driven at a slower speed or is even braked.

In an alternative embodiment that can also be used in addition, the course of the web can be continuously changed to produce the relative speed. In the simplest case, this is done by changing the position of at least one guide roll before and/or after the roll to be cleaned.

To produce the relative speed, the roll is preferably made to run faster with respect to the web. For the actual cleaning process it is of secondary importance whether the web or the surface of the roll runs faster, as long as the necessary relative speed is present. However, the cleaning time can be reduced if the surface of the roll has a greater speed than the web.

A cleaning agent is preferably applied to the web and/or to the roll. A cleaning fluid improves the cleaning process. The roll is, as it were, "wiped down with a wet cloth."

It is hereby particularly preferred for the cleaning agent to be applied to the roll in an area that is arranged after the lifting of the web from the roll. The cleaning agent is thus applied at the outlet of the cleaning zone, so that the exposure time of the cleaning agent on the surface of the roll is relatively long. The cleaning agent can act on the surface of the roll until the roll comes into contact with the web again. Afterwards the web can remove the softened or soaked contaminants from the surface of the roll.

It is also advantageous if saturated steam is used as the cleaning agent and the surface of the roll is kept at a temperature of a maximum of 80° C. The saturated steam then condenses on the surface of the roll so that the contaminants can be removed together with the moisture that has formed due to the steam. Cleaning with the aid of steam is particularly effective in many cases.

Alternatively, petroleum, volatile hydrocarbons or water can be used as the cleaning agent, whereby the water is possibly mixed with cleaning additives. As a rule, these cleaning agents are able to help in detaching the contaminants from the surface of the roll.

Preferably several rolls in a calender are cleaned with the same section at the same time. This saves time. The consumption of the web that later has to be disposed of is kept relatively small.

It is hereby preferred that the rolls cleaned at the same time are all embodied as soft rolls or all embodied as hard rolls. Specific cleaning parameters, e.g., the relative speed or the contact pressure, can then be adapted to the type of the rolls. The cleaning result can thereby be optimized.

The present invention is directed to a process for cleaning at least one roll of a calender. The process includes guiding a web over a surface of the at least one roll of the calender to be cleaned, and producing a relative speed difference between the surface of the least one roll and a section of the web lying against the surface of the a least one roll.

According to a feature of the invention, the process can further include disposing of the section of the web lying against the surface of the at least one roll.

In accordance with another feature of the invention, the calender can include a nip formed in part by the at least one roll to be cleaned and, before producing the relative speed difference, the nip may be opened.

The guiding of the web can include stretching the web against the surface of the at least one roll to be cleaned.

Further, an angle of wrap of the web around the surface of the at least one roll to be cleaned can increase as the web is guided over the surface to be cleaned.

Moreover, the process can be performed one of shortly after and shortly before a reel spool, on which the web is wound, is changed.

According to another feature of the present invention, the process can be performed during a reel spool change and the section of the web lying against the surface of the at least one roll to be cleaned can be guided into a pulper.

In accordance with the invention, the relative speed difference can be set to at least 100 m/min.

To produce the relative speed difference, the drive speed of the at least one roll to be cleaned can be changed.

Further, to produce the relative speed difference, a travel path of the web can be continuously changed.

Also, to produce the relative speed difference, the at least one roll can be driven at a speed faster than a running speed of the web. The relative speed difference between a surface of the at least one roll and the web may be at least 100 m/min.

To produce the relative speed difference, the at least one roll can be braked to run at a speed slower than a running speed of the web. The relative speed difference between a surface of the at least one roll and the web can be at least 100 m/min.

The process may further include applying a cleaning agent to at least one of the web and the at least one roll. The cleaning agent can be applied to the at least one roll at an area located after a lifting of the web from a surface of the at least one roll, with respect to the roll rotational direction. Further, the cleaning agent can include saturated steam and the process can further include maintaining a surface of the at least one roll a maximum temperature of 80° C. Moreover, the cleaning agent can include at least one of petroleum, volatile hydrocarbons and water. The cleaning agent may also include water mixed with other cleaning additives.

According to a further feature of the instant invention, the calender can include a plurality of rolls to be cleaned, and the plurality of rolls may be concurrently cleaned with a same section of the web. The concurrently cleaned rolls can be one of all soft rolls and all hard rolls. Further, the calender may include positionably movable guide rolls and the process can further include moving the section of web via the guide rolls to contact the surfaces of the plurality of rolls to be cleaned. To produce the relative speed difference, the plurality of rolls to be cleaned can be driven at a speed faster than a running speed of the web. Alternatively, to produce the relative speed difference, the plurality of rolls to be cleaned can be braked to run at a speed slower than the running speed of the web. Otherwise, to produce the relative speed difference, some of the plurality of rolls to be cleaned can be driven at a speed faster than a running speed of the web, and a remainder of the plurality of rolls to be cleaned may be braked to run at a speed slower than the running speed of the web.

The present invention is directed to a process for cleaning at least one roll of a calender. The process includes opening a nip of the calender through which the web is guided, in which the nip is formed in part by the at least one roll, contacting a surface of the at least one roll with a section of the web, and adjusting surface speed of the at least one roll to produce a relative speed difference between the surface of the least one roll and the section of the web contacting the surface of the a least one roll.

In accordance with a feature of the instant invention, the surface speed of the at least one roll can be increased to produce a relative speed difference of at least 100 m/min.

According to another feature of the invention, the surface speed of the at least one roll can be braked to produce a relative speed difference of at least 100 m/min.

Further, the section of the web, after cleaning the at least one roll, can be wound as an inner layer on a new reel spool. Alternatively, the section of the web, after cleaning the at least one roll, is wound as an outer layer on a completed reel spool. Otherwise, the section of the web, after cleaning the at least one roll, may be guided into a pulper.

In accordance with still yet another feature of the present invention, the calender can include a plurality of rolls to be cleaned, and the plurality of rolls may be contacted by the section of the web. The plurality of rolls to be cleaned can be one of all soft rolls and all hard rolls. Further, the calender can include positionably movable guide rolls and the process may further include stretching the section of web via the guide rolls over the surfaces of the plurality of rolls to be cleaned. To produce the relative speed difference, the plurality of rolls to be cleaned can be driven at a speed faster than a running speed of the web. Alternatively, to produce the relative speed difference, the plurality of rolls to be cleaned may be braked to run at a speed slower than the running speed of the web. Otherwise, to produce the relative speed difference, some of the plurality of rolls to be cleaned may be driven at a speed faster than a running speed of the web, and a remainder of the plurality of rolls to be cleaned may be braked to run at a speed slower than the running speed of the web.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
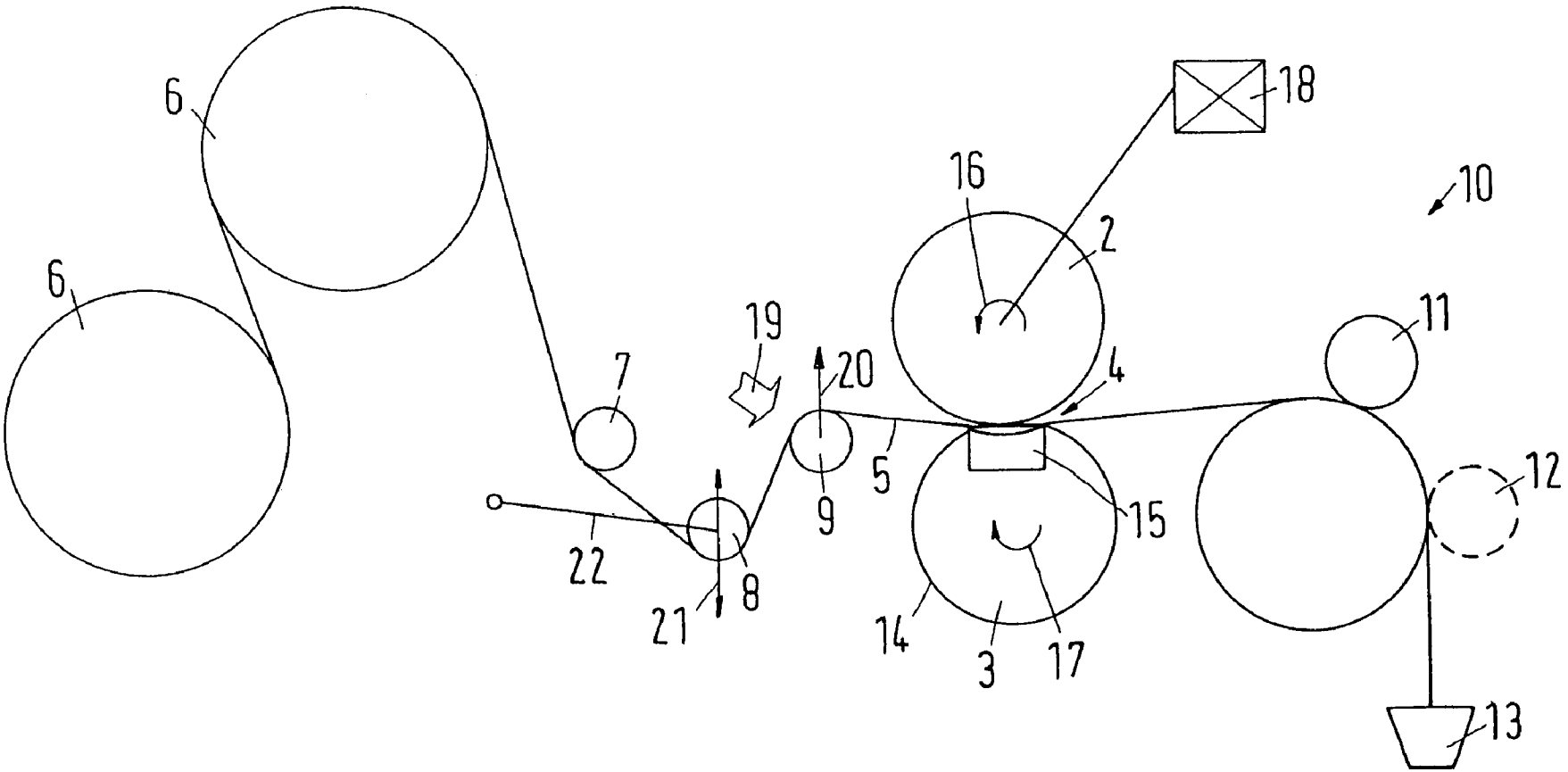
FIG. 1 illustrates the process for cleaning of a calender having two rolls.

FIG. 1 shows a calender 1 with a roll 2 to be cleaned and a shoe roll 3 that are arranged to form a wide (elongated) nip 4. A web 5, e.g., a paper or cardboard web, is guided through wide nip 4 from drying cylinders 6 of a paper machine. Web 5 runs over several guide rolls 7–9 that are arranged forward of calender 1 in the travel direction of web 5. A winder 10 is arranged behind calender 1 to wind web 5 onto a reel spool 11 or 12 or, if winding is dispensed with, is guided into a pulper 13.

Shoe roll 3 is formed by a rotating jacket 14 that can be pressed against roll 2 with the aid of a support shoe 15. To clean roll 2, support shoe 15 is lowered, whereby wide nip 4 is opened.

Roll 2 rotates in the direction of an arrow 16, and jacket 14 circulates in the direction of arrow 17. At least roll 16 is driven by a drive 18 (shown only diagrammatically).

An applicator device 19 for a cleaner is provided on last guide roll 9 before wide nip 4. Applicator device 19 can apply, e.g., petroleum, volatile hydrocarbons or water onto web 5. Moreover, if necessary, water can also be mixed with cleaning additives.

To clean roll 2, wide nip 4 is opened, as mentioned above.

If it is necessary, last guide roll 9 arranged before wide nip 4 is displaced in the direction of arrow 20 so that web 5 is brought to rest on roll 2 with a certain force, i.e., web 5 is, as it were, stretched against the surface of roll 2. On the other side of wide nip 4, web 5 is held by reel spool 11 or 12. If necessary, guide roll 9 can be further displaced so that roll 2 is wound about by web 5 over a greater angle of wrap.

Winder 10 continues to work normally during the cleaning process. Moreover, while drive 18 continues to drive roll 2, the circumferential speed of roll 2, i.e., the speed of its surface, is increased relative to the speed of web 5 drawn toward reel 11 or 12. In this manner, a relative speed difference occurs between the surface of roll 2 and web 5 so that web 5 rubs across the surface of roll 2. In this way, contaminants that have been deposited on the surface of roll 2 are rubbed off, and roll 2 is cleaned.

Alternatively or additionally, second guide roll 8 can be shifted continuously in the direction of a double arrow 21. To this end, guide roll 8 can be arranged, e.g., on a lever 22 that is continuously pivoted back and forth so that is possible to effect a change in speed of web 5 and thus to change the relative speed difference between web 5 and the surface of roll 2. Accordingly, web 5 is moved back and forth relative to roll 2, i.e., alternately at greater and lesser speeds.

Applicator device 19 sprays or squirts a cleaner onto web 5, namely on the side arranged to lie against or contact the surface of roll 2 to be cleaned. In this way, web 5 is thereby moistened so as to better be able to clean roll 2.

Of course, it is also possible to reduce the circumferential speed of roll 2 relative to the speed of web 5, i.e., to brake roll 2, to achieve the relative speed difference. Drive 18 can also be used for this. However, the use of a higher speed has the advantage that the cleaning process as a whole can be completed faster.

It is advisable for the cleaning process to take place shortly before or shortly after a reel spool change. If the cleaning process occurs shortly before a reel spool change, the section of the web that has been used to clean the roll is wound onto the reel spool as an outer, multi-ply layer. In many cases this layer cannot be used further anyway and must be disposed of. If the cleaning process occurs shortly after a reel spool change, the section of the web used for cleaning and, therefore, is soiled is wound on the reel spool as the inner layer. This section of the web is also usually discarded.

Alternatively, the cleaning process can naturally also take place during a reel spool change. In this case, the section of web 5 which has been used for cleaning, can be guided directly into pulper 13.

It is also possible to wind the section of web 5 used for cleaning roll 2 onto a separate reel spool 12 and to then later dispose of this wound section.

The speed difference between web 5 and the surface of roll 2 should be at least 100 m/min. However, greater speed differences or relative speeds are advantageous if roll 2 is to be cleaned quickly.

Figure 2:
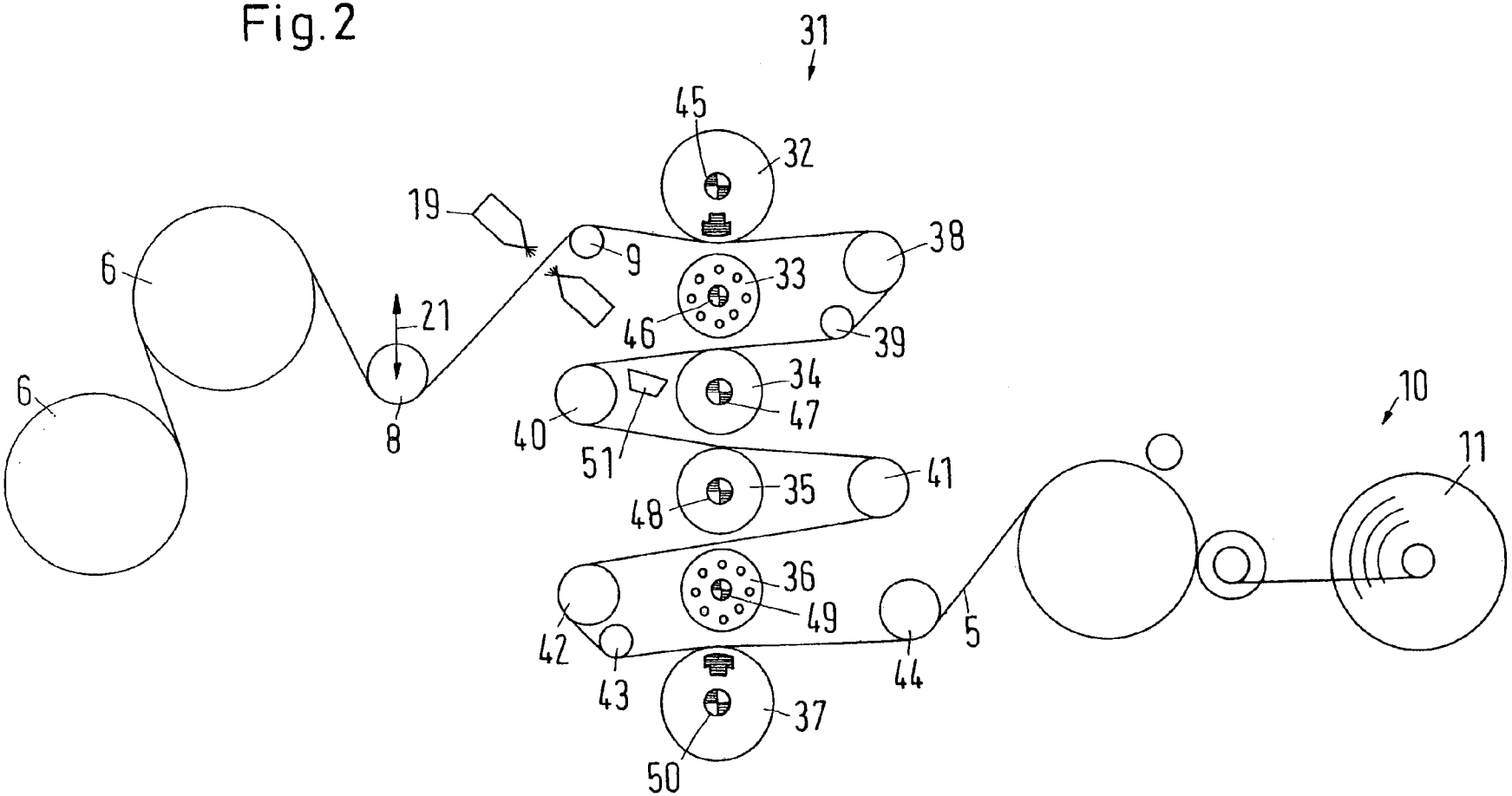
FIG. 2 illustrates the process for cleaning of a multi-roll calender.

FIG. 2 shows another embodiment of a multi-roll calender 31 with a total of six rolls 32–37, of which rolls 33 and 36 are embodied or formed as hard, heated rolls and the other rolls are embodied or formed as soft rolls, i.e., rolls with an elastic coating. The two end rolls 32 and 37 are embodied or formed as sag (deflection) compensation rolls.

Parts corresponding to those elements discussed in FIG. 1 are given the same reference numbers.

Due to the larger number of rolls 32–37, more guide rolls 38–44 are also necessary. Guide rolls 38–44 can be partially displaced, in particular rolls 9, 39, and 43 that are arranged shown.

For cleaning, all the nips between rolls 32–37 are opened, as shown in FIG. 2. Guide rolls 9, 39, and 43 are adjusted or positioned such that web 5 lies against rolls 32, 34, 35, and 37, but does not touch hard rolls 33 and 36. If necessary, web 5 can form a predetermined angle of wrap with the touched rolls. Moreover, if it is desired to clean hard rolls 33 and 36, the guide rolls 38–44 are positioned such that web 5 lies against hard rolls 33 and 36.

All rolls 32–37 feature a drive 45–50, so that it is possible to set a difference speed between the surfaces of the rolls and web 5 with all rolls 32, 34, 35, and 37 to be cleaned. It is noted that it is not absolutely essential for the relative speed between the surfaces of individual rolls 32, 34, 35, and 37 and web 5 to be the same in all cases. It is even permissible if one or more of the rolls has a circumferential speed that is lower than the speed of web 5, whereas the remaining rolls have a circumferential speed that is greater than the speed of web 5.

Additionally or alternatively to applicator device 19 for cleaners, which in the instant embodiment applies cleaner to both sides of web 5, another applicator device 51 for cleaners can be provided which applies the cleaner to roll 34. Of course, all the other depicted rolls can also be provided with corresponding applicator devices for cleaners, even though not explicitly shown in the exemplary illustration.

Applicator device 51 applies the cleaner at a position that lies directly after the contact of web 5 with roll 34. In this manner, the cleaner applied by applicator device 51 can act on the surface of roll 34 over an almost complete revolution of roll 34. Thus, contaminants on the surface of the roll 34 are "softened" or already partially detached.

Applicator device 51 can also apply steam, preferably saturated steam, to the surface of roll 34. It is hereby favorable if the surface of roll 34 is kept at a temperature of a maximum of 80° C.

However, not only the rolls of a calender that are used to pressurize a web 5 can be cleaned with the cleaning process shown. Guide rolls 7–9 and 38–44 can also be cleaned in this same way. However, because a drive would not normally be provided here, it is advisable to use a braking device for these guide rolls in order to produce a relative speed between web 5 and these guide rolls.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for cleaning at least one roll of a calender comprising:

guiding a web over a surface of the at least one roll of the calender to be cleaned; and producing a relative speed difference between the surface of the least one roll and a section of the web lying against the surface of the a least one roll, wherein the calender comprises a nip formed in part by the at least one roll to be cleaned, and before producing the relative speed difference, the nip is opened.

2. The process in accordance with claim 1, further comprising disposing of the section of the web lying against the surface of the at least one roll.

3. A process for cleaning at least one roll of a calender comprising:

guiding a web over a surface of the at least one roll of the calender to be cleaned; and producing a relative speed difference between the surface of the least one roll and a section of the web lying against the surface of the a least one roll, wherein the guiding of the web includes stretching the web against the surface of the at least one roll to be cleaned.

4. The process in accordance with claim 3, wherein an angle of wrap of the web around the surface of the at least one roll to be cleaned increases as the web is guided over the surface to be cleaned.

5. The process in accordance with claim 3, wherein the relative speed difference is set to at least 100 m/min.

6. The process in accordance with claim 3, wherein, to produce the relative speed difference, the drive speed of the at least one roll to be cleaned is changed.

7. The process in accordance with claim 3, wherein, to produce the relative speed difference, a travel path of the web is continuously changed.

8. The process in accordance with claim 3, wherein to produce the relative speed difference, the at least one roll is driven at a speed faster than a running speed of the web.

9. The process in accordance with claim 8, wherein the relative speed difference between a surface of the at least one roll and the web is at least 100 m/min.

10. The process in accordance with claim 3, wherein to produce the relative speed difference, the at least one roll is braked to run at a speed slower than a running speed of the web.

11. The process in accordance with claim 10, wherein the relative speed difference between a surface of the at least one roll and the web is at least 100 m/min.

12. The process in accordance with claim 3, further comprising applying a cleaning agent to at least one of the web and the at least one roll.

13. The process in accordance with claim 12, wherein the cleaning agent is applied to the at least one roll at an area located after a lifting of the web from a surface of the at least one roll, with respect to the roll rotational direction.

14. The process in accordance with claim 12, wherein the cleaning agent comprises at least one of petroleum, volatile hydrocarbons and water.

15. The process in accordance with claim 14, wherein the cleaning agent comprises water mixed with other cleaning additives.

16. The process in accordance with claim 3, wherein the calender comprises a plurality of rolls to be cleaned, and the plurality of rolls are concurrently cleaned with a same section of the web.

17. The process in accordance with claim 16, wherein the concurrently cleaned rolls are one of all soft rolls and all hard rolls.

18. The process in accordance with claim 16, wherein the calender includes positionably movable guide rolls and the process further comprises moving the section of web via the guide rolls to contact the surfaces of the plurality of rolls to be cleaned.

19. The process in accordance with claim 16, wherein to produce the relative speed difference, the plurality of rolls to be cleaned are driven at a speed faster than a running speed of the web.

20. The process in accordance with claim 16, wherein to produce the relative speed difference, the plurality of rolls to be cleaned are braked to run at a speed slower than the running speed of the web.

21. A process for cleaning at least one roll of a calender comprising:

guiding a web over a surface of the at least one roll of the calender to be cleaned; and producing a relative speed difference between the surface of the least one roll and a section of the web lying against the surface of the a least one roll, wherein the process is performed one of shortly after and shortly before a reel spool, on which the web is wound, is changed.

22. A process for cleaning at least one roll of a calender comprising:

guiding a web over a surface of the at least one roll of the calender to be cleaned; and producing a relative speed difference between the surface of the least one roll and a section of the web lying against the surface of the a least one roll, wherein the process is performed during a reel spool change and the section of the web lying against the surface of the at least one roll to be cleaned is guided into a pulper.

23. A process for cleaning at least one roll of a calender comprising:

guiding a web over a surface of the at least one roll of the calender to be cleaned;

producing a relative speed difference between the surface of the least one roll and a section of the web lying against the surface of the a least one roll; and applying a cleaning agent to at least one of the web and the at least one roll, wherein the cleaning agent comprises saturated steam and the process further comprises maintaining a surface of the at least one roll a maximum temperature of 80° C.

24. A process for cleaning at least one roll of a calender comprising:

guiding a web over a surface of the at least one roll of the calender to be cleaned; and producing a relative speed difference between the surface of the least one roll and a section of the web lying against the surface of the a least one roll;

wherein the calender comprises a plurality of rolls to be cleaned, and the plurality of rolls are concurrently cleaned with a same section of the web; and wherein to produce the relative speed difference, some of the plurality of rolls to be cleaned are driven at a speed faster than a running speed of the web, and a remainder of the plurality of rolls to be cleaned are braked to run at a speed slower than the running speed of the web.

25. A process for cleaning at least one roll of a calender comprising:

opening a nip of the calender through which the web is guided, wherein the nip is formed in part by the at least one roll;

contacting a surface of the at least one roll with a section of the web; and adjusting surface speed of the at least one roll to produce a relative speed difference between the surface of the least one roll and the section of the web contacting the surface of the a least one roll.

26. The process in accordance with claim 25, wherein the surface speed of the at least one roll is increased to produce a relative speed difference of at least 100 m/min.

27. The process in accordance with claim 25, wherein the surface speed of the at least one roll is braked to produce a relative speed difference of at least 100 m/min.

28. The process in accordance with claim 25, wherein the section of the web, after cleaning the at least one roll, is wound as an inner layer on a new reel spool.

29. The process in accordance with claim 25, wherein the section of the web, after cleaning the at least one roll, is wound as an outer layer on a completed reel spool.

30. The process in accordance with claim 25, wherein the section of the web, after cleaning the at least one roll, is guided into a pulper.

31. The process in accordance with claim 25, wherein the calender comprises a plurality of rolls to be cleaned, and the plurality of rolls are contacted by the section of the web.

32. The process in accordance with claim 31, wherein the plurality of rolls to be cleaned are one of all soft rolls and all hard rolls.

33. The process in accordance with claim 31, wherein the calender includes positionably movable guide rolls and the process further comprises stretching the section of web via the guide rolls over the surfaces of the plurality of rolls to be cleaned.

34. The process in accordance with claim 31, wherein to produce the relative speed difference, the plurality of rolls to be cleaned are driven at a speed faster than a running speed of the web.

35. The process in accordance with claim 31, wherein to produce the relative speed difference, the plurality of rolls to be cleaned are braked to run at a speed slower than the running speed of the web.

36. The process in accordance with claim 31, wherein to produce the relative speed difference, some of the plurality of rolls to be cleaned are driven at a speed faster than a running speed of the web, and a remainder of the plurality of rolls to be cleaned are braked to run at a speed slower than the running speed of the web.

* * * * *